US009618285B2

(12) United States Patent
Leimer

(10) Patent No.: US 9,618,285 B2
(45) Date of Patent: Apr. 11, 2017

(54) REMOVABLE MAGAZINE FOR A RIFLE

(71) Applicant: L&O Hunting Group GmbH, Isny (DE)

(72) Inventor: Jan Leimer, Mestecko Trnavka (CZ)

(73) Assignee: L&O HUNTING GROUP GMBH, Isny (DE)

( * ) Notice: Subject to any disclaimer, the term of this patent is extended or adjusted under 35 U.S.C. 154(b) by 0 days.

(21) Appl. No.: 14/852,840

(22) Filed: Sep. 14, 2015

(65) Prior Publication Data

US 2016/0076840 A1 Mar. 17, 2016

(30) Foreign Application Priority Data

Sep. 15, 2014 (DE) ..... 10 2014 113 242

(51) Int. Cl.

| | |
|---|---|
| ***F41A 9/64*** | (2006.01) |
| ***F41A 9/65*** | (2006.01) |
| ***F41A 9/66*** | (2006.01) |
| ***F41A 9/70*** | (2006.01) |

(52) U.S. Cl.

CPC *F41A 9/64* (2013.01); *F41A 9/65* (2013.01); *F41A 9/66* (2013.01); *F41A 9/70* (2013.01)

(58) Field of Classification Search

CPC ..... F41A 9/64; F41A 9/65; F41A 9/66; F41A 9/70

USPC ..... 42/50

See application file for complete search history.

(56) References Cited

U.S. PATENT DOCUMENTS 527,869 A * 10/1894 Mauser ..... F41A 9/65 42/50
667,856 A * 2/1901 Wagner ..... F41A 9/65 42/50
1,290,833 A * 1/1919 Hammond ..... F41A 17/38 42/18
2,325,484 A * 7/1943 Kucher ..... F41A 9/65 42/18
2,642,688 A * 6/1953 Johnson, Jr. ..... F41A 9/65 42/18
2,655,753 A * 10/1953 Salas ..... F41A 9/65 42/18
2,657,489 A * 11/1953 Robertson, Jr. ..... F41A 9/65 42/50
2,701,504 A * 2/1955 Schaich ..... F41A 9/47 42/50
2,710,476 A * 6/1955 Garand ..... F41A 17/38 42/18

(Continued)

FOREIGN PATENT DOCUMENTS

DE 120862 A 5/1901
DE 102006009 895 B3 7/2007

OTHER PUBLICATIONS

Result of Examination for German Patent Application No. 10 2014 113 242.4 filed Sep. 15, 2014.

*Primary Examiner* — Joshua Freeman

(74) *Attorney, Agent, or Firm* — Paul D. Bianco; Katharine Davis; Fleit Gibbons Gutman Bongini & Bianco PL

(57) ABSTRACT

A removable magazine for a rifle with a support and a magazine insert disposed on the support, the magazine insert having, in the direction of fire, a back side and a front side with an opening for bullets of cartridges insertable into the magazine insert. The magazine insert is mounted on the support so as to be able to pivot around a transverse axis by a pivot bearing disposed on the back side thereof.

19 Claims, 2 Drawing Sheets

(56) References Cited

U.S. PATENT DOCUMENTS 2,715,789 A * 8/1955 Garand ..... F41A 9/65 42/50
2,745,203 A * 5/1956 Ruple ..... F41A 9/65 42/18
2,875,544 A * 3/1959 Krieger ..... F41A 9/59 42/18
2,908,097 A * 10/1959 Allyn ..... F41A 9/66 42/18
2,997,803 A * 8/1961 Florence ..... F41A 9/70 42/18
3,019,542 A * 2/1962 Manthos ..... F41A 9/65 42/18
3,235,994 A * 2/1966 Grippo ..... F41A 17/38 42/50
3,390,476 A * 7/1968 Vervier ..... F41A 17/38 42/50
3,509,654 A * 5/1970 Vorgrimler ..... F41A 9/65 42/50
3,574,264 A * 4/1971 Simmons, Sr. ..... F41A 17/38 42/50
3,803,739 A * 4/1974 Haines ..... F41A 17/38 42/50
4,237,638 A * 12/1980 Trexler ..... F41A 11/02 42/6
5,416,998 A * 5/1995 Martel ..... F41A 17/38 42/49.02
5,685,101 A * 11/1997 Ferretti ..... F41A 9/65 42/18
5,899,013 A * 5/1999 Hauser ..... F41A 17/38 42/6
6,164,000 A * 12/2000 Lumplecker ..... F41A 9/71 42/17
7,941,955 B2 * 5/2011 Stone ..... F41A 9/25 42/50
7,963,062 B1 6/2011 Rothärmel et al.
8,959,818 B2 * 2/2015 Mayerl ..... F41A 9/55 42/6

* cited by examiner

REMOVABLE MAGAZINE FOR A RIFLE

FIELD OF THE DISCLOSURE

The disclosure relates to a removable magazine.

BACKGROUND

A removable magazine of this kind is known from DE 10 2006 009 859 B3. The same comprises a support with a shaft-shaped housing and a magazine insert for receiving cartridges, disposed in the housing of the support. In this known plug magazine, when inserted, the magazine insert has its based fixed to a lower part of the magazine shaft and can only be moved up and down within the housing. Due to a special inner contour of the magazine insert, the bullet tip of the topmost of the cartridges within the magazine insert tilts slightly upward, but special precautions must be taken to facilitate the feeding of the cartridge into the chamber during the operation of the breechblock and to prevent collision between the insert and the breechblock during return.

SUMMARY OF THE DISCLOSURE

In one embodiment, a removable magazine is disclosed that makes possible both the trouble-free transfer of cartridges into the cartridge chamber and simplified reloading.

Other useful developments and advantageous embodiments are also disclosed.

In the removable magazine according to the disclosure, the magazine insert is mounted on the support so as to be able to pivot around a transverse axis via a pivot bearing. The magazine insert can thus be pivoted on the support between a lower position and an upwardly pivoted cartridge tracking position. In the upwardly pivoted cartridge tracking position, the magazine insert of the removable magazine that is inserted properly into the magazine shaft of a rifle is disposed in such a way that the uppermost cartridge, viewed in the shooting direction, is obliquely oriented and the bullet tip thereof already points towards the cartridge chamber. By this means, the insertion of cartridges into the cartridge chamber during forward movement of the breechblock can be greatly simplified.

In a preferred embodiment, the pivot bearing may be disposed at a lower end of the back side of the magazine insert. The pivot bearing can, for example, also be disposed at the upper end of the back wall. By this means, the magazine insert is also pivotable in the desired manner.

The pivot bearing may advantageously be formed to engage in a corresponding inwardly semicircularly arched groove on the support, by means of an outwardly semicircularly formed ridge that projects backward from the back side of the magazine insert. The pivot bearing may however also be designed in another way.

The magazine insert can be moved on the carrier between an upwardly pivoted cartridge feeding position and a downwardly pressed lower position. The magazine insert can advantageously be pushed into the upwardly pivoted cartridge feed position by, for example, a leaf spring configured as a pressure spring.

Control surfaces with an inclined control slope may be furnished on at least one outer side of two parallel side walls of the magazine insert, so as to control the pivoting movement of the magazine insert.

The magazine insert may advantageously be disposed within a shaft-shaped housing of the support. For guiding the magazine insert and limiting the pivoting movement, outwardly projecting pins may be furnished on both of the two parallel side walls of the magazine insert so as to engage with arc-shaped oblong holes on the two parallel side walls of the housing.

In a further advantageous embodiment, a trigger unit may be disposed on the support with a trigger guard and trigger, so that the trigger unit can be removed together with the plug magazine of the gun. The magazine and the trigger unit make up a single assembly, stored and transported separately from the gun, but if necessary they can also be quickly reassembled. Thus, the gun can not only discharge quickly and easily, but, for example, may be quickly reloaded with the entire magazine capacity and full readiness to fire after climbing into a hunting blind. For this purpose, the plug magazine with the trigger unit attached thereto must be plugged into a corresponding seat in a breechblock housing. By this means, safe handling of the rifle can be greatly improved.

BRIEF DESCRIPTION OF THE DRAWINGS

Further details and advantages of the disclosure will become apparent from the following description of a preferred embodiment with reference to the drawing. The drawings are.

DETAILED DESCRIPTION

Figure 1:
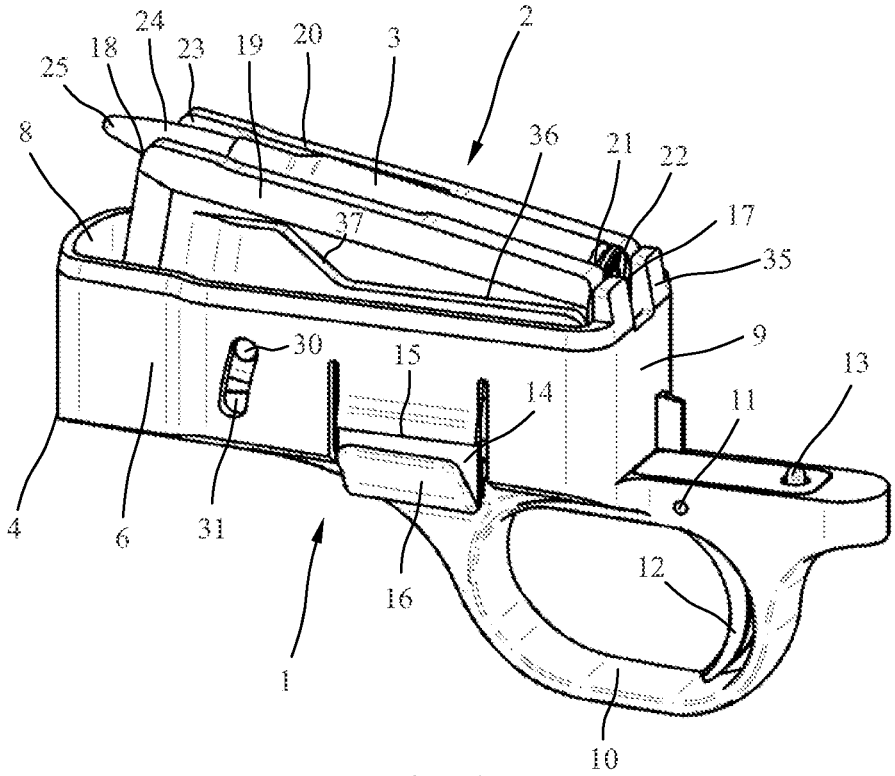
FIG. 1 perspective view of a removable magazine according to the disclosure with a raised magazine insert.
Figure 2:
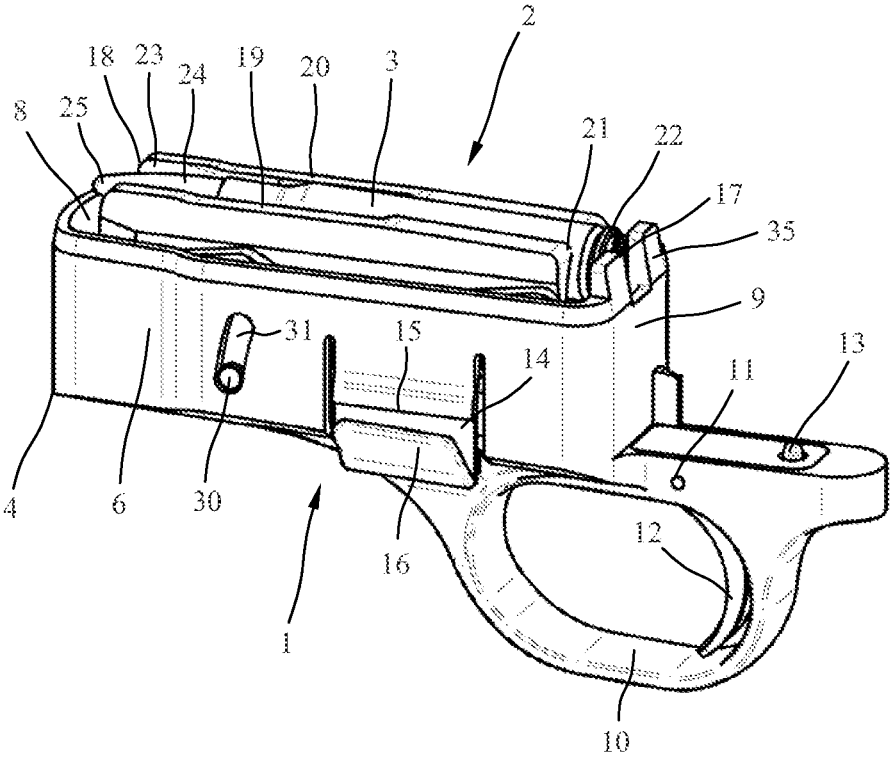
FIG. 2 perspective view of the removable magazine of FIG. 1 with raised magazine, with inserted magazine insert.

In FIGS. 1 to 4, different views are shown of a removable magazine that can be inserted into a rifle and has a support 1 and a magazine insert 2, disposed on the support 1 for receiving multiple cartridges 3. The support 1 has a shaft-shaped housing 4 that has a floor 5 shown in FIG. 3, two side walls 6 and 7 spaced apart from one another, and a front transverse wall 8 and a rear transverse wall 9, seen in the direction of fire. In the embodiment shown, the support 1 additionally comprises a trigger assembly with a trigger guard 10 and a trigger 12 that is rotatable around a transverse axis 11. When the removable magazine is removed from the magazine shaft of the rifle, at the same time, the trigger guard 10 and trigger 12 are removed, whereby weapon safety can be improved. The support 1 can however also be configured without the trigger assembly. In the embodiment shown, the trigger guard 10 is formed as a single unit with the shaft-like housing 4, but it can also be formed as a separate component that is connected to the housing 4 by bolts or other fastening elements. The trigger 12, which is rotatable about the transverse axis 11, comprises at its back end a cam 13 that protrudes upward, which engages with a trigger mechanism, not shown, when the removable magazine is inserted.

Laterally elastic tabs 14 are furnished on both side walls 6 and 7 of the housing 4, having an upper locking lug 15 and a lower grip part 16. If the changing magazine has been properly inserted into the magazine shaft of the rifle, the locking tabs 15 catch on corresponding recesses in the lateral inner walls of the magazine shaft of the rifle, whereby the removable magazine is held securely to the rifle. To remove the removable magazine, both tabs 14 may be pressed together via the grip parts 16 projecting thereunder; by this means, the locking lugs 15 are disengaged from the corresponding recesses.

The magazine insert 2, which is disposed within the housing 4 of the support 1 and serves to receive multiple cartridges 3, contains, in the direction of fire, a back side 17, a front side 18, and two side walls 19 and 20 that are spaced apart from one another, between which the cartridges 3 are held. In the sloping back side 17 of the magazine insert 2, there is a passage 21 for the case 22 of the cartridge 3. In the front side 18 of the magazine insert 2, there is an opening 23 for the bullet 24 of the cartridge 3. The opening 23 in the front side 18 is configured in such a way that the tips 25 of the bullets 24 may project forward relative to the magazine insert 2. The magazine insert 2, consisting for example of plastic, additionally has a base 26 that is visible in FIG. 3. The magazine insert 2 can be adjusted to a desired caliber and is simple to replace if necessary.

Figure 3:
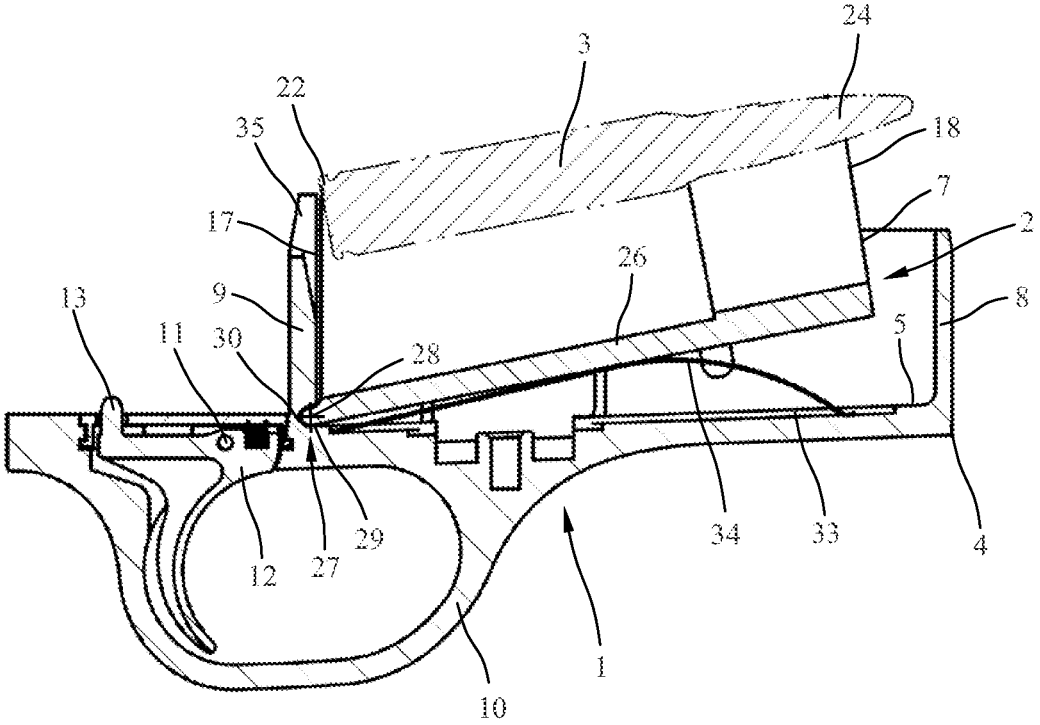
FIG. 3 longitudinal section of the removable magazine of FIG. 1, with raised magazine insert.
Figure 4:
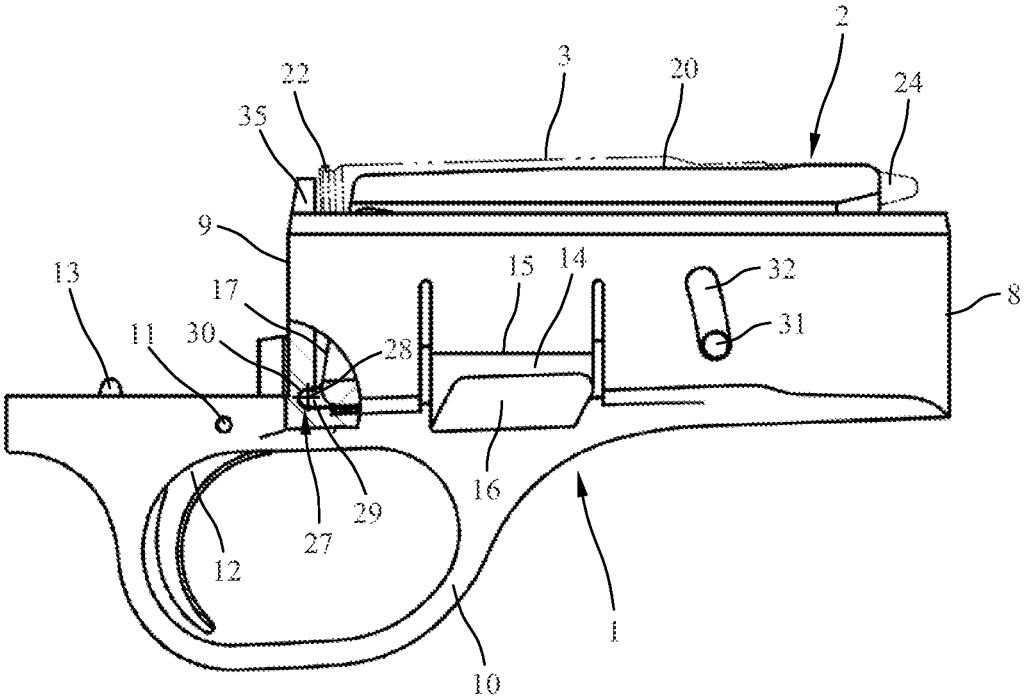
FIG. 4 side view of the removable magazine of FIG. 2, with inserted magazine insert.

As is apparent from FIGS. 3 and 4, the magazine insert 2 is mounted on the support 1 so as to be able to pivot around a transverse axis 28 via a pivot bearing 27 disposed on the back side 17 of the magazine insert 2. The pivot bearing 27, in the embodiment shown, is disposed on the lower end of the back side 17 of the magazine insert 2, and is formed by a semicircularly-shaped ridge 29 that projects backward from the back side 17 of the magazine insert 2, which engages with a corresponding inwardly semicircularly arched groove 30 on the inner side of the back transverse wall 9 of the housing 4. The magazine insert 2 can be moved on the support 1 between an upwardly pivoted cartridge feeding position, shown in FIG. 3, and a downwardly pressed lower position, shown in FIG. 4, by means of the pivot bearing 27. To guide the magazine insert 2 and limit the pivoting motion, on the outer sides of the two parallel side walls 19 and 20 of the magazine insert 2, outwardly projecting pins 31 are disposed that engage in arc-shaped slots 32 in the two parallel side walls 6 and 7 of the housing 4 on the support 1. In a depression 33 on the floor 5 of the shaft-shaped housing 4, which is visible in FIG. 3, a compression spring 34 is disposed which here is configured as a leaf spring, by which means the magazine insert 2 is pressed into the upper cartridge feed position. The compression spring 34 is affixed between the floor 5 of the housing 4 and the floor 26 of the magazine insert 2.

At the upper end of the rear transverse wall 9 of the housing 4, two upwardly protruding ridges 35 are disposed, through which the upper cartridge 3 is pushed when pivoting the magazine insert 2 forward, from the lower position shown in FIG. 4 to the cartridge feeding position shown in FIG. 3.

From FIG. 1, it is apparent that on the outside of the side wall 19 of the magazine insert 2, control surfaces 36 are disposed having a control ramp 37 that extends obliquely upward so as to control the pivoting movement of the magazine insert 2. By a push rod or a control rail of a breechblock, not shown here, the movement of the magazine insert 2 can e.g. be controlled so that when the breechblock is closed for the feed of the cartridge into the chamber, the magazine insert first remains in the upwardly pivoted cartridge feed position and then moves into the depressed lower position via the control ramp 36, so that during the return movement of the breechblock after firing, there is no collision between the returning breechblock and the magazine.

What is claimed is:

1. A removable magazine for a rifle comprising: a support; and a magazine insert mounted on the support; the magazine insert comprising: in a direction of fire of the rifle, a back side, a front side, and two parallel side walls spaced apart from one another between which cartridges are held, the front side having an opening therein to receive bullets from the cartridges; wherein the magazine insert is pivotable around a transverse axis via a pivot bearing disposed on the back side of the magazine insert; wherein the removable magazine is removable from the rifle; and wherein the magazine insert is movable between an upwardly pivoted cartridge-feeding position and a downwardly-pressed lower position.

2. The removable magazine according to claim 1, wherein the support is formed as a shaft-shaped housing having a floor, two side walls spaced apart from one another, a front wall, and a rear wall.

3. The removable magazine according to claim 2, wherein the magazine insert is disposed within the shaft-shaped housing.

4. The removable magazine according to claim 2, wherein the pivot bearing is formed by a semicircularly-shaped ridge that projects backwardly from the back side of the magazine insert, the pivot bearing engaging with a corresponding inwardly semicircular arched groove formed in an inner side of the rear wall of the shaft-shaped housing.

5. The removable magazine according to claim 2, further comprising two upwardly-protruding ridges formed at an upper end of the rear wall of the shaft-shaped housing, the two upwardly-protruding ridges engaging a case of a cartridge.

6. The removable magazine according to claim 2, further comprising outwardly-projecting pins on outer surfaces of the two parallel side walls of the magazine insert, the outwardly-projecting pins engaging arc-shaped slots in the side walls of the shaft-shaped housing.

7. The removable magazine according to claim 2, further comprising laterally elastic tabs on both side walls of the shaft-shaped housing, each of the laterally elastic tabs having an upper locking lug and a lower grip part, wherein upper locking lugs engage corresponding recesses in lateral inner walls of a magazine shaft of the rifle.

8. The removable magazine according to claim 1, wherein the pivot bearing is disposed at a lower end of the back side of the magazine insert.

9. The removable magazine according to claim 1, wherein the magazine insert is pressed into the upwardly pivoted cartridge-feeding position by a compression spring.

10. The removable magazine according to claim 1, wherein an outer surface of at least one of the parallel side walls of the magazine insert includes a control surface having an obliquely-extended slope configured to control pivoting movement of the magazine insert.

11. The removable magazine according to claim 1, further comprising a removable trigger assembly formed with or attached to the support including a trigger guard and a trigger, the trigger assembly rotatable around a transverse axis.

12. A removable magazine for a rifle comprising:

a support; and a magazine insert mounted on the support; the magazine insert comprising:

in a direction of fire of the rifle, a back side, a front side, and two parallel side walls spaced apart from one another between which cartridges are held, the front side having an opening therein to receive bullets from the cartridges;

wherein the magazine insert is pivotable around a transverse axis via a pivot bearing disposed on the back side of the magazine insert;

wherein the magazine insert is movable between an upwardly pivoted cartridge-feeding position and a downwardly-pressed lower position, the magazine insert pressed into the upwardly pivoted cartridge-feeding position by a compression spring; and wherein the removable magazine is removable from the rifle.

13. The removable magazine according to claim 12, wherein the support is formed as a shaft-shaped housing having a floor, two side walls spaced apart from one another, a front wall, and a rear wall.

14. The removable magazine according to claim 13, wherein the magazine insert is disposed within the shaft-shaped housing.

15. The removable magazine according to claim 13, wherein the pivot bearing is formed by a semicircularly-shaped ridge that projects backwardly from the back side of the magazine insert, the pivot bearing engaging with a corresponding inwardly semicircular arched groove formed in an inner side of the rear wall of the shaft-shaped housing.

16. The removable magazine according to claim 13, further comprising laterally elastic tabs on both side walls of the shaft-shaped housing, each of the laterally elastic tabs having an upper locking lug and a lower grip part, wherein upper locking lugs engage corresponding recesses in lateral inner walls of a magazine shaft of the rifle.

17. The removable magazine according to claim 12, wherein the pivot bearing is disposed at a lower end of the back side of the magazine insert.

18. The removable magazine according to claim 12, further comprising a removable trigger assembly formed with or attached to the support including a trigger guard and a trigger, the trigger assembly rotatable around a transverse axis.

19. A removable magazine for a rifle comprising:

a support, the support formed as a shaft-shaped housing having a floor, two side walls spaced apart from one another, a front wall, and a rear wall; and a magazine insert mounted on the support; the magazine insert comprising:

in a direction of fire of the rifle, a back side, a front side, and two parallel side walls spaced apart from one another between which cartridges are held, the front side having an opening therein to receive bullets from the cartridges; and outwardly-projecting pins on outer surfaces of the two parallel side walls, the outwardly-projecting pins engaging arc-shaped slots in the side walls of the shaft-shaped housing;

wherein the magazine insert is pivotable around a transverse axis via a pivot bearing disposed on the back side of the magazine insert.

* * * * *